US006064019A

United States Patent [19]

Buchan et al.

[11] Patent Number: 6,064,019

[45] Date of Patent: May 16, 2000

[54] RESILIENT SWITCH COVER WITH INTEGRAL ACTUATOR BUTTON

[76] Inventors: Brian D. Buchan, 2643 Argyle Avenue, Kamloops, BC, Canada, V2B 4T6; Brent A. Kornelson, 961 C Laval Crescent, Kamloops, BC, Canada, V2C 5P4

[21] Appl. No.: 09/299,603

[22] Filed: Apr. 27, 1999

[51] Int. Cl.[7] ..... H01H 13/70

[52] U.S. Cl. ..... 200/302.2; 200/5 A; 200/341

[58] Field of Search ..... 200/5 A, 511, 200/512, 517, 520, 302.1, 302.2, 329, 333, 341, 345

[56] References Cited

U.S. PATENT DOCUMENTS

| | | | |
|---|---|---|---|
| 4,237,351 | 12/1980 | Boulanger et al. | 200/5 A |
| 4,323,740 | 4/1982 | Balash | 200/5 A |
| 4,471,177 | 9/1984 | Doughty | 200/5 A |
| 4,471,189 | 9/1984 | Bacon et al. | 200/159 B |
| 4,499,343 | 2/1985 | Prioux et al. | 200/5 A |
| 5,258,592 | 11/1993 | Nishikawa et al. | 200/302.2 |
| 5,340,955 | 8/1994 | Calvillo et al. | 200/302.2 |
| 5,362,934 | 11/1994 | Inagaki et al. | 200/520 |
| 5,475,192 | 12/1995 | Inagaki et al. | 200/341 |

*Primary Examiner*—Michael Friedhofer
*Attorney, Agent, or Firm*—Antony C. Edwards

[57] ABSTRACT

A switch cover includes a resilient flexible membrane having an outer surface and an opposite inner surface for mounting onto a switch plate. The flexible membrane has at least one aperture therethrough, and may have a plurality of aperture corresponding to the member of switch controls desired. Each aperture has a switch actuator button snugly journalled therethrough and mounted to the membrane so as to leave an outer portion of the button protruding above the outer surface of the membrane for tactile feedback to an operator. An inner portion of the button extends generally perpendicularly from the inner surface of the membrane for actuating engagement with a corresponding switch actuator on the switch plate.

19 Claims, 1 Drawing Sheet

RESILIENT SWITCH COVER WITH INTEGRAL ACTUATOR BUTTON

FIELD OF THE INVENTION

This invention relates to the field of resilient covers for electrical switch plates, and in particular, switch plates which contain one or more flush mounted push-button type electrical switches. It is a further object to provide a switch actuator button having a head portion raised above the resilient switch cover and an actuator portion which extends inwardly of the cover to engage an electrical switch.

BACKGROUND OF THE INVENTION

The use of a flexible membrane to cover electrical switches is in common use, for example, in calculator and telephone keypads. Such covers are advantageously utilized as an effective means of protecting the switches from dirt and moisture. Currently, each switch located beneath the flexible switch cover is generally identified by printing illustrations on the switch cover at the switch locations or by embossing the flexible cover to create raised areas at the switch locations. These techniques have limited application since embossing of the flexible cover is limited to 1.5 times the thickness of the material and provide very limited tactile feedback and illustrations printed upon the face may be rendered obscure by soiling. In addition the presently used means of switch identification requires that the operator be able to visually confirm the switch location.

It is an object of the present invention to provide an actuator, generally in the form of a button, which is riveted to the resilient switch cover and which is raised above the surface of the switch cover. The raised surface will then provide sufficient tactile feedback to the operator to permit positive identification of the switch locations, under either lighting conditions that would obscure printed surface illustrations, or work conditions where a machinery operator must keep his eyes focussed on the work-end of the machinery without being distracted by looking for switch identifiers.

It is a further object to provide a switch actuator button having a head portion raised above the resilient switch cover and an actuator portion which extends inwardly of the cover to engage an electrical switch.

SUMMARY OF THE INVENTION

The resilient switch cover with integral actuator button of the present invention includes a weatherproof flexible membrane, which may be resilient. The membrane is trimmed to match the shape of the electrical switch plate so as to be mounted to an upper surface thereof. The face of the membrane may have printed thereon an image generally in the form of circular outlines which identify the precise location of the electrical switches aligned with, and mounted to the underside of the electrical switch plate. A portion within the circular switch identification outline is removed to form an aperture. The aperture permits the attachment of a switch actuator button. The underside of the resilient cover, that is, the side which is affixed to the upper surface of the electrical switch plate, is coated with an adhesive. The adhesive adheres the switch cover to the switch plate.

A switch actuator button is mounted to the switch cover in the manner of a rivet. The button has an actuator shaft extending perpendicularly from the button. The shaft protrudes through the switch cover. Surrounding the actuator shaft and integrally formed with the head is a relatively thin-walled sleeve which is spaced radially outwardly from the shaft. The outer diameter of the thin-walled sleeve is sized to permit it to be inserted through the aperture formed in the resilient switch cover. The diameter of the head portion of the button is greater than the diameter of the aperture formed in the resilient switch cover so that upon deformation of the thin-walled sleeve by heat and pressure the actuator button is firmly affixed, in the manner of riveting, to the resilient switch cover.

Riveting of the actuator button to the resilient switch cover leaves the button portion raised or protruding above the upper surface of the switch cover for ease of tactile location of the button by the operator. The actuator shaft, extends so as to engage a corresponding electrical switch of the electrical switches mounted to the underside of the switch plate.

In summary, the switch cover of the present invention includes a resilient flexible membrane having an outer surface and an opposite inner surface for mounting onto a switch plate. The flexible membrane has at least one aperture therethrough, and may have a plurality of aperture corresponding to the member of switch controls desired. Each aperture has a switch actuator button snugly journalled therethrough and mounted to the membrane so as to leave an outer portion of the button protruding above the outer surface of the membrane for tactile feedback to an operator. An inner portion of the button extends generally perpendicularly from the inner surface of the membrane for actuating engagement with a corresponding switch actuator on the switch plate. Advantageously the button is mounted to the membrane in the manner of a rivet. The switch actuator may be a plunger cooperating with a switch. In the preferred embodiment, the outer portion of the button has a diameter larger than a corresponding diameter of the aperture in the membrane, and the inner portion of the button comprises an elongate plunger shaft co-axial with a deformable sleeve enclosing the plunger shaft. The deformable sleeve has a diameter corresponding to the diameter of the aperture for snug journalling of the inner portion of the button through the aperture. The sleeve is deformable, for example in the manner of a rivet, for the mounting of the button to the membrane. Thus, the deformable sleeve may be radially outwardly spaced from the plunger shaft.

In one asect of the present invention the outer surface of the membrane has a visual indicator thereon indicating location of the outer portion of the button. The visual indicator may be an encircling contrasting mark on the outer surface of the membrane encircling the upper portion of the button.

In a further aspect, the upper surface of the membrane has a raised annular surface thereon generally surrounding the aperture in the membrane. Advantageously the annular surface and the aperture in the membrane are co-axial. Also, the switch plate may have an annular depression corresponding to the annular surface when the membrane is mounted on the switch plate.

DETAILED DESCRIPTION OF THE PREFERRED EMBODIMENT

Figure 1A:
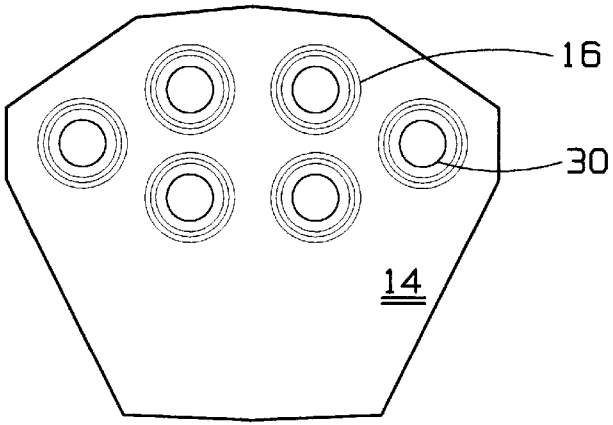
FIG. 1*a* is the switch cover of FIG. 1 without actuator buttons.
Figure 3:
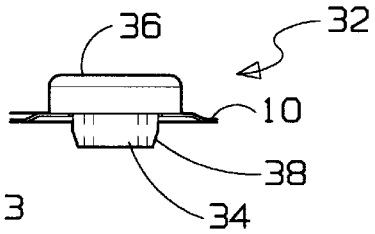
FIG. 3 is an enlarged sectional view of the actuator button, before riveting of the button to the switch cover.
Figure 1:
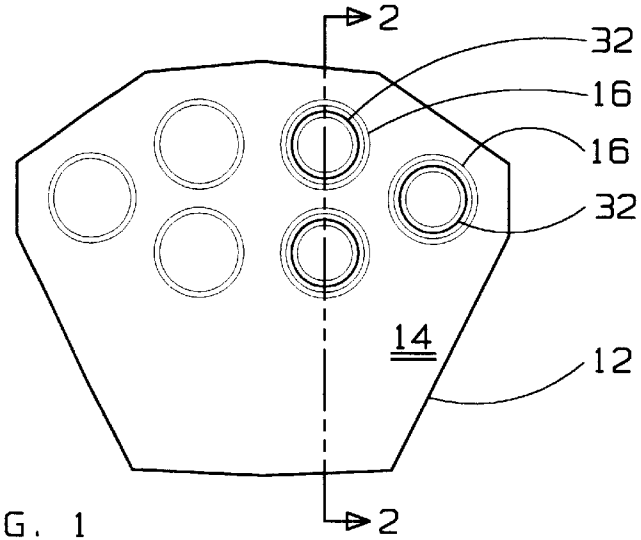
FIG. 1 is a perspective of the resilient switch cover with actuator buttons in place.
Figure 2:
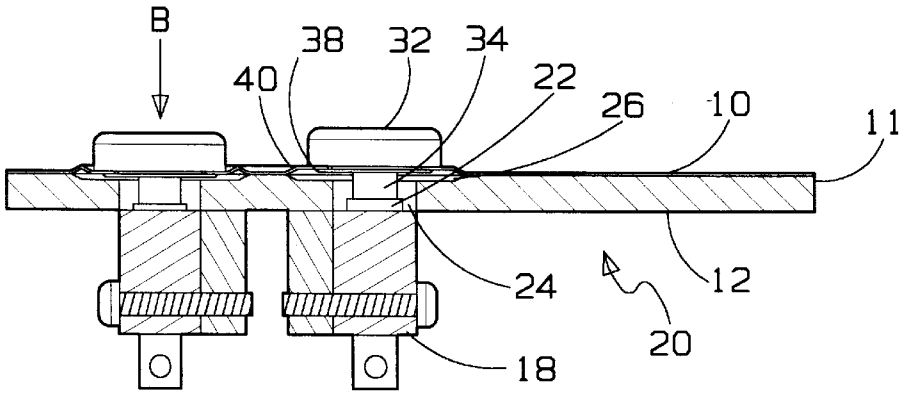
FIG. 2 is an enlarged sectional view along line 2—2 of FIG. 1.

As illustrated in FIGS. 1–3, resilient switch cover 10 is a thin flexible membrane. The membrane may be of fabric or of other material known in the art. The membrane may be readily trimmed to fit the shape of an electrical switch plate 12. The upper face 14 of the switch cover 10 has an image 16 printed thereon, which is generally a circular or polygonal outline. The image 16 identifies the location of a push-button type of electrical switch 18 which is mounted to the underside 20 of the switch plate 12. The actuator 22 of switch 18 is accessible through an aperture 24 formed through switch plate 12. An annular recess 26 is formed on the upper surface of switch plate 12, surrounding aperture 24. The diameter of recess 26 generally matches the diameter of image 16 printed on the face of switch cover 10. Switch cover 10 is secured to the upper face of switch plate 12 by an adhesive 11, which covers the lower mating surface of cover 10 except for the areas generally opposite to the images 16 which identify the locations of switches 18. A hole 30 is formed in switch cover 10, within each printed image 16, which permits a switch actuator button 32 to be attached.

As may be seen in FIG. 3, actuator button 32 has an actuator shaft 34 with a button or head portion 36 formed at one end. A thin-walled sleeve 38 is integrally formed with head portion 36, to extend outwardly from head 36 parallel to and radially spaced outwardly from the actuator shaft 34.

Figure 3A:
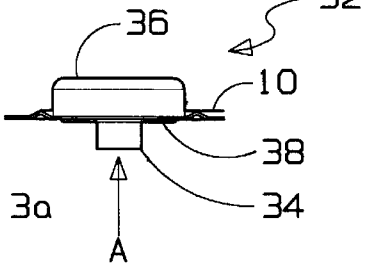
FIG. 3*a* is the actuator button of FIG. 3, after riveting of the button to the switch cover.

The diameter of sleeve 38 permits it to be inserted through hole 30 in switch cover 10. Head portion 36 of actuator button 32 is large in diameter that hole 30 which ensures that head portion 36 of button 32 is retained on the upper surface 14 of switch cover 10. Once positioned through hole 30 in cover 10, the actuator button 32 may be riveted in place onto switch cover 10 by applying heat and pressure to thin-walled sleeve 38 in direction "A" generally parallel to the longitudinal axis thereof as seen in FIG. 3*a* to deform sleeve 38 against the underside of the resilient switch cover 10. With sleeve 38 so deformed and mounted onto cover 10, switch actuator shaft 34 extends well below cover 10. When switch cover 10 is applied to switch plate 12, shaft 34 extends through aperture 24 formed in switch plate 12 to contact switch actuator 22 of electrical switch 18

Recess 26 formed in the upper surface of switch plate 12 allows resilient switch cover 10 to be depressed slightly below the upper surface of plate 12 when actuator button 32 is pushed downward to operate switch 18. As may be seen in FIG. 2, a raised or domed area 40 can be formed surrounding the button 32 within the area of image 16 on cover 10. This domed area 40 is advantageous when controller 22 of switch 18 is a plunger requiring a greater plunger stroke distance B.

Alternatively, the domed area 40 may be inverted so as to, in its normal position, extend slightly below upper surface 14 of resilient switch cover 10. In either case the head portion 36 of button 32 will protrude above surface 14 of cover 10 to thereby enable an operator to obtain tactile feedback for the positive identification of switch locations.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A switch cover comprising a resilient flexible membrane having an outer surface and an opposite inner surface for mounting onto a switch plate, the membrane having an aperture therethrough, a switch actuator button snugly journalled through the aperture and riveted to the membrane so as to leave an outer portion of the button protruding above the outer surface of the membrane for tactile feedback to an operator and so as to extend an inner portion of the button snugly through the aperture so as to prevent movement of the button relative to the membrane, the inner portion of the button extending generally perpendicularly from the inner surface of the membrane for actuating engagement with a corresponding switch actuator on the switch plate, wherein said button is guided only by said membrane in a vertical translation direction when said button is depressed, so as to deform said membrane, and released so as to return said button to a non-depressed position.

2. The switch cover of claim 1 wherein the button is riveted to the membrane.

3. The switch cover of claim 2 wherein the outer surface of the membrane has a visual indicator thereon indicating location of the outer portion of the button.

4. The switch cover of claim 3 wherein the visual indicator is an encircling contrasting mark on the outer surface of the membrane encircling the outer portion of the button.

5. The switch cover of claim 2 wherein the upper surface of the membrane has a raised annular surface thereon generally surrounding the aperture in the membrane.

6. The switch cover or claim 5 wherein the annular surface and the aperture are co-axial.

7. The switch cover of claim 5 wherein the switch plate has an annular depression corresponding to the annular surface when the membrane is mounted on the switch plate.

8. The switch cover or claim 1 wherein the outer portion of the button has a diameter larger than a corresponding diameter of the aperture in the membrane, and the inner portion of the button comprises an elongate plunger shaft coaxial with a deformable sleeve enclosing the plunger shaft the deformable sleeve having a diameter corresponding to the diameter of the aperture for the snug journalling of the inner portion through the aperture and deformable for the mounting of the button to the membrane.

9. The switch cover of claim 8 wherein the deformable sleeve is riveted onto the membrane.

10. The switch cover of claim 9 wherein the deformable sleeve is radially outwardly spaced apart from the plunger shaft.

11. The switch cover of claim 8 wherein the outer surface of the membrane has a visual indicator thereon indicating location of the outer portion of the button.

12. The switch cover of cover of claim 11 wherein the visual indicator is an encircling contrasting mark on the outer surface of the membrane encircling the outer portion of the button.

13. The switch cover of claim 8 wherein the upper surface of the membrane has a raised annular surface thereon generally surrounding the aperture in the membrane.

14. The switch cover of claim 13 wherein the annular surface and the aperture arc co-axial.

15. The switch cover of claim 13 wherein the switch plate has an annular depression corresponding to the annular surface when the membrane is mounted on the switch plate.

16. The switch cover of claim 1 wherein the switch actuator is a plunger co-operating with a switch.

17. A switch cover comprising a resilient flexible membrane having an outer surface and an opposite inner surface for mounting onto a switch plate, the membrane having an aperture therethrough, a switch actuator button snugly journalled through the aperture and mounted to the membrane so as to leave an outer portion of the button protruding above the outer surface of the membrane for tactile feedback to an operator and so as to extend an inner portion of the button generally perpendicularly from the inner surface of the membrane for actuating engagement with a corresponding switch actuator on the switch plate, wherein the outer portion of the button has a diameter larger than a corresponding diameter of the aperture in the membrane, and the inner portion of the button comprises an elongate plunger shaft co-axial with a deformable sleeve enclosing the plunger shaft, the deformable sleeve having a diameter corresponding to the diameter of the aperture for the snug journalling of the inner portion through the aperture and deformable for the mounting of the button to the membrane.

18. The switch cover of claim 17 wherein the deformable sleeve is riveted onto the membrane.

19. The switch cover of claim 1 wherein the deformable sleeve is radially outwardly spaced apart from the plunger shaft.

* * * * *